US006786150B2

(12) United States Patent
Drew et al.

(10) Patent No.: US 6,786,150 B2
(45) Date of Patent: Sep. 7, 2004

(54) PRINTING PRESS ROLL HAVING AUXILIARY ROTATION CAPABILITY

(75) Inventors: Gerald Joseph Drew, New Durham, NH (US); David Elliott Whitten, Barrington, NH (US); Mark Anthony Wingate, Rochester, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/123,351

(22) Filed: Apr. 16, 2002

(65) Prior Publication Data

US 2003/0192441 A1 Oct. 16, 2003

(51) Int. Cl.[7] ..... B41F 13/03

(52) U.S. Cl. ..... 101/228; 101/219; 226/92; 416/171

(58) Field of Search ..... 101/219, 228; 226/92; 416/171; 415/80, 91

(56) References Cited

U.S. PATENT DOCUMENTS

| | | | | | |
|---|---|---|---|---|---|
| 1,464,070 | A | * | 8/1923 | Glanschnig | 415/210.1 |
| 3,442,504 | A | * | 5/1969 | Halley | 493/439 |
| 3,745,838 | A | * | 7/1973 | Brems | 74/27 |
| 3,995,553 | A | * | 12/1976 | Winterholler et al. | 101/228 |
| 4,480,801 | A | * | 11/1984 | Stone | 242/532.7 |
| 5,605,267 | A | | 2/1997 | Whitten | 226/91 |
| 5,718,661 | A | * | 2/1998 | Michalik | 493/439 |

FOREIGN PATENT DOCUMENTS

JP 57084853 A * 5/1982

* cited by examiner

*Primary Examiner*—Andrew H. Hirshfeld
*Assistant Examiner*—Jill E. Culler
(74) *Attorney, Agent, or Firm*—Davidson, Davidson & Kappel, LLC

(57) ABSTRACT

A roll for a web printing press includes a cylindrical member configured for supporting a web, the cylindrical member being rotatable about an axis of rotation. A motor device is disposed at the axis of rotation for rotating the cylindrical member so as to advance the web over the cylindrical member during a webbing-up operation.

14 Claims, 6 Drawing Sheets

PRINTING PRESS ROLL HAVING AUXILIARY ROTATION CAPABILITY

BACKGROUND

The present invention relates generally to web printing presses and more particularly to a printing press roll having a non-contacting and disengageable motor device for rotating the roll during webbing-up.

To prepare for printing operations in a web offset lithographic printing press, the web end must first be fed over the various rolls and through the various nips in the press to the end of the press. This process is known as "webbing-up." Webbing-up may be performed in a variety of ways including manually, or by using automatic or semi-automatic web-up systems. As part of the webbing-up process an operator may manually rotate a roll to feed the web past the roll. Such manual feeding and roll rotation operations can be difficult and time-consuming, as well as present a safety hazard to the operator.

For example, former rolls below a former may be rotated by hand to assist in feeding the web through the nip area between the former rolls of a folder and into the lower portion of the folder. Because the web drives the rolls and due to the fact that the rolls are in close proximity to each other, there is a nip hazard present, i.e., there is a danger that the operator's hand may become caught between the rolls and injured. Several guard designs have been employed in previous machines to protect the operator from the nip area. Many of these prior guard designs inhibit the operator from rotating the rolls to assist in webbing up.

Commonly-owned U.S. Pat. No. 5,605,267 describes a device for automatically advancing the end of a web over a former and into a folder unit in a printing press. A motor is used to rotate an endless belt which contacts the web and advances the web over the former and down through the former rolls. The motor also rotates the former rolls via belts to push the web through the former rolls and into the folder. A machined groove is required in one or both of the former rolls, which may result in marking on the printed product.

Prior devices may be complex and expensive.

SUMMARY OF THE INVENTION

The present invention provides a roll for a web printing press. The roll includes a cylindrical member configured for supporting a web, the cylindrical member being rotatable about an axis of rotation. Also included is a non-contacting and disengageable motor device disposed at the axis of rotation and configured for rotating the cylindrical member so as to advance the web over the cylindrical member during a webbing-up operation.

The cylindrical member may be movable axially and laterally and the motor device may be movable therewith. The motor device may be operable in conjunction with an automatic webbing-up system. Moreover, the motor device may be further configured for permitting the cylindrical member to rotate freely during a printing operation, or "normal operation," of the printing press.

The motor device may include an electric motor. The electric motor may be disposed at an end portion of the cylindrical member. Moreover, the electric motor may be housed within the cylindrical member.

The motor device may include a fluid motor. The fluid motor may be an air motor including a plurality of vanes attached to the cylindrical member and an air source configured for blowing air against the vanes so as to cause the cylindrical member to rotate. The vanes may be housed within the cylindrical member or within a housing disposed at an end of the cylindrical member. The air source may include an air outlet integrated in the shaft and disposed so as to blow air against the vanes. Moreover, the air source may include an air outlet disposed outside the cylindrical member so as to blow air against the vanes.

The roll may further include a control device for controlling a flow of air to the air motor, the control device being configured for stopping the flow of air to the air motor a predetermined time after a release of an operator air flow activation device.

The roll according to the present invention maybe a former roll.

The present invention also provides a web printing press including a cylindrical member configured for supporting a web, the cylindrical member being rotatable about an axis of rotation. A motor device is disposed at the axis of rotation and configured for rotating the cylindrical member so as to assist the advance of the web over the cylindrical member during a webbing-up operation.

The present invention also provides a method for rotating a roll in a web printing press during a webbing-up operation. The method includes: providing a motor device disposed at an axis of rotation of the roll and configured for rotating the roll so as to advance the web over the roll; and operating the motor device so as to rotate the roll.

The present invention provides a relatively inexpensive way of remotely rotating rolls, such as former rolls, during webbing-up, allowing a more complete roll/nip guard design.

BRIEF DESCRIPTION OF THE DRAWINGS

The present invention is elaborated upon below based on exemplary embodiments with reference to the accompanying drawings.

DETAILED DESCRIPTION

Figure 1B:
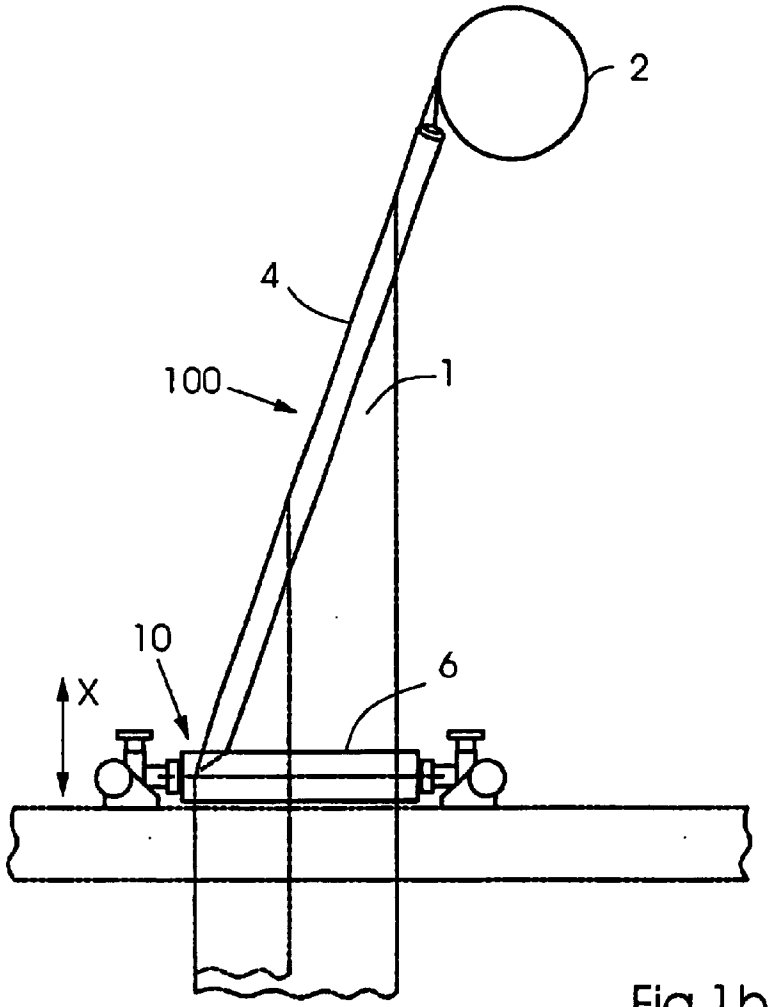
FIG. 1B shows a schematic side elevational view of the former of FIG. 1A.
Figure 1A:
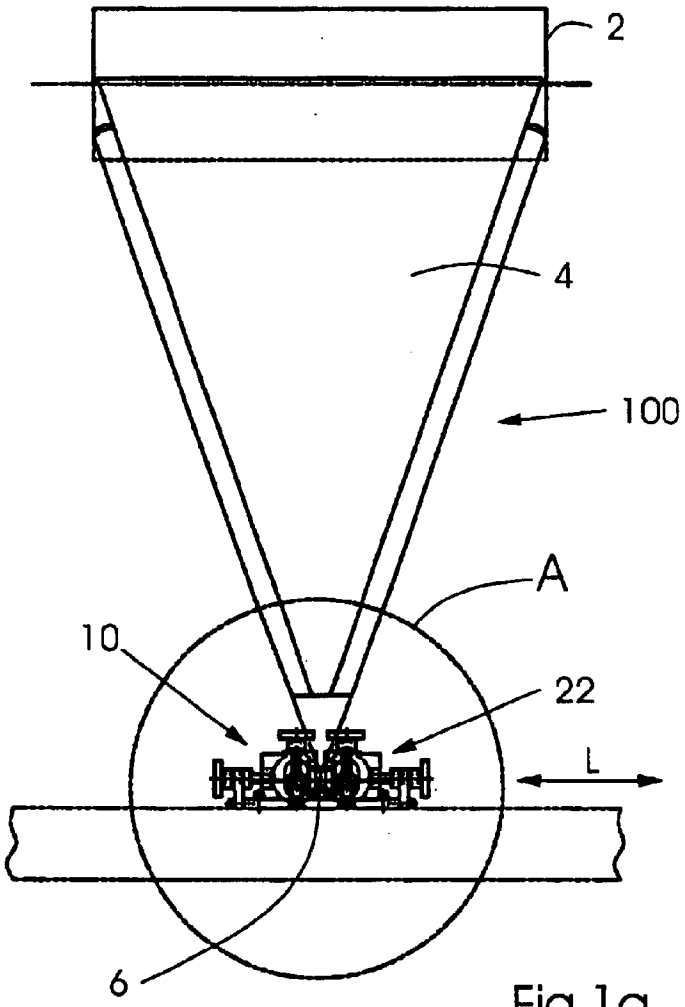
FIG. 1A shows a schematic front elevational view of a former according to an embodiment of the present invention.

FIGS. 1A and 1B show schematic views of a former 100 according to an embodiment of the present invention. Former 100 includes cylinder 2, former board 4 and former rolls 10. Web 1 travels over cylinder 2 and down former board 4 through nip 6 between former rolls 10. Due to the triangular shape of former board 4 and the interaction with former rolls 10, web 1 is folded as it travels through former 100.

Figure 2:
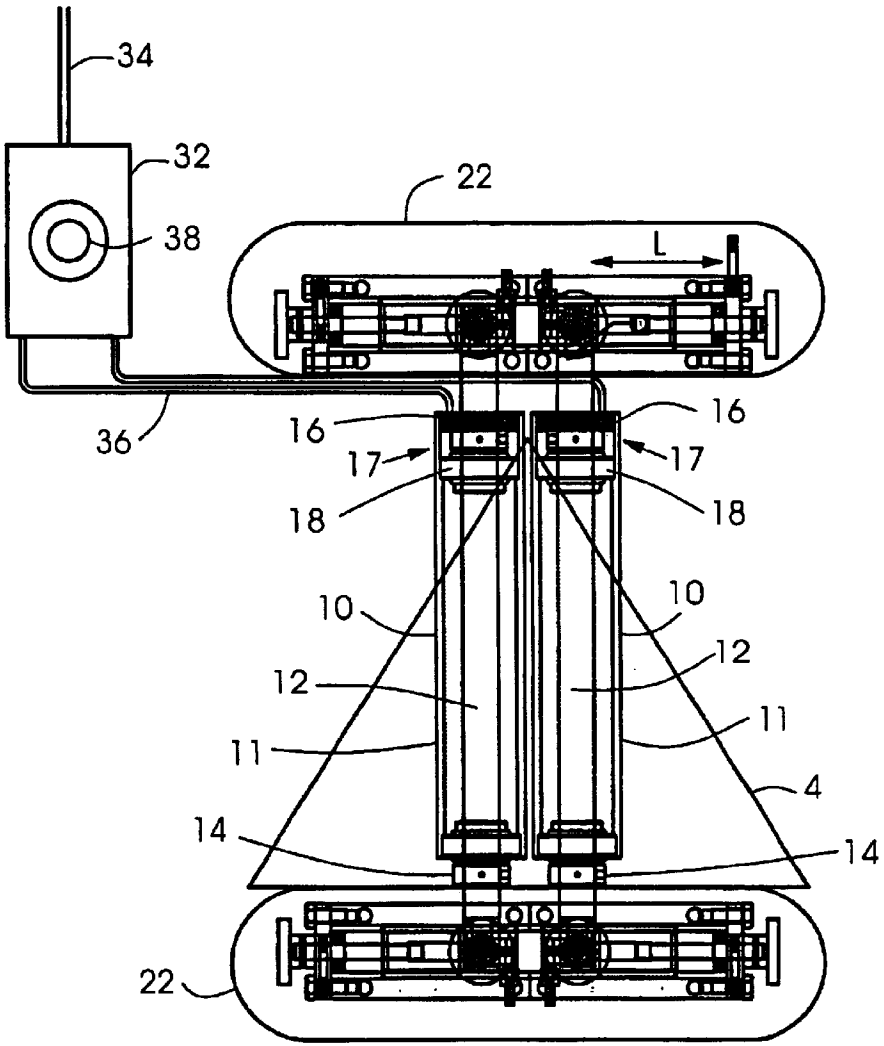
FIG. 2 shows a detail schematic plan view of area A of FIG. 1A according to an embodiment of the present invention using an electric motor.

FIG. 2 shows a detail schematic plan view of area A of FIG. 1A according to an embodiment of the present invention using an electric motor 17. Former rolls 10 each include respective outer cylindrical member 11 which rotates about respective shaft 12. Adjustment devices 22 permit former rolls 10 to be moved horizontally and vertically in the direction of axes L and X (see FIG. 1B), respectively, for adjustment purposes. Former rolls 10 are each provided with respective electric motor 17. Each electric motor 17 includes stator member 16 and rotor member 18. Stator member 16 is affixed to shaft 12, while rotor member 18 is affixed to cylindrical member 11 radially outside the stator member. By the electromagnetic interaction between rotor member 18 and stator member 16, rotor member 18—and with it cylindrical member—is caused to rotate about shaft 12 on bearings 14 disposed at either end of the shaft.

Stator member 16 and rotor member 18 of electric motor 17 may be disposed inside cylindrical member 11, as shown in FIG. 2. As such, a compact design is provided in which electric motor 17 moves with cylindrical member 11 when the position of former roll 10 is adjusted using adjustment device 22. In other embodiments of the present invention, electric motor 17 may be disposed on an end portion of shaft 12 outside of cylindrical member 11. In such embodiments, electric motor 17 also moves with former roll 11 when the position of former roll 10 is adjusted using adjustment device 22. Of course other configurations of electric motor 17 are possible. In some embodiments of the present invention, for example, stator member 16 may be disposed radially outside rotor member 18 so that rotor member 18 rotates inside of, rather than, outside of stator member 16.

Control device 32 is provided for controlling the speed of electric motor 17. Power is supplied to control device 32 via electric line 34. Power is supplied from control device 32 to electric motor 17 via electric line 36. Control device 32 includes control button 38, which permits an operator to activate and/or stop the rotation of cylindrical member 11. Control device may include a timer mechanism which acts to keep electric motor 17 energized, and thereby rotor member 18 rotating, for a predetermined time, which maybe variable, after an operator pushes control button 38. When no power is provided to electric motor 17, former roll 10 may rotate freely under the action of moving web 1 during printing operations, for example.

Figure 3:
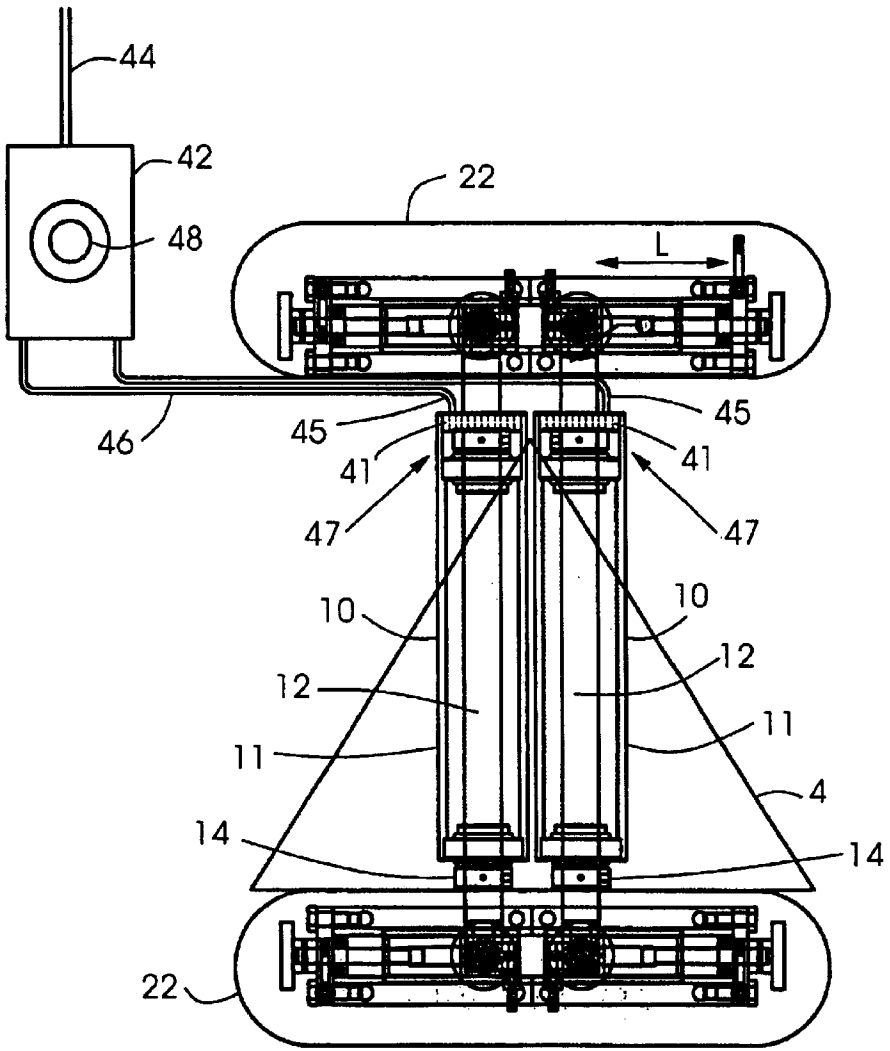
FIG. 3 shows a detail schematic plan view of area A of FIG. 1A according to another embodiment of the present invention using an air motor.

FIG. 3 shows a detail schematic plan view of area A of FIG. 1A according to another embodiment of the present invention using an air motor 47. Former rolls 10 each include respective outer cylindrical member 11 which rotates about respective shaft 12. Adjustment devices 22 permit former rolls 10 to be moved horizontally and vertically in the direction of axes L and X (see FIG. 1B), respectively, for adjustment purposes. Former rolls 10 and are each provided with respective air motor 47. Each air motor 47 includes air nozzle 45 and vanes 41. Air nozzle 45, fed by air line 46, is fixed relative to shaft 12, while vanes 41 are affixed to the inside of cylindrical member 11 (see FIG. 4). As such, a compact design is provided in which vanes 41 move with cylindrical member 11 when the position of former roll 10 is adjusted using adjustment device 22. Air from air nozzle 45 is blown against vanes 41, causing the vanes to move and thereby causing cylindrical member 11 to rotate about shaft 12 on bearings 14 disposed at either end of the shaft. In other embodiments of the present invention, air from air nozzle 45 may be blown into a chamber (not shown) and then allowed to escape through vanes 41, causing the vanes to move. Spent air may exit cylindrical member 11 via open ends of the cylindrical member or any other suitable openings provided for this purpose (not shown).

Control device 42 is provided for controlling air motor 47. Air is supplied to control device 42 via air line 44. Air is supplied from control device 42 to air motor 47 via air line 46. Air line 46 may be flexible along at least a portion of its length, to permit nozzle 45 to move during position adjustment of former roll 10 using adjustment device 22. Control device 42 includes control button 48, which permits an operator to activate and/or stop the rotation of cylindrical member 11. Control device 42 may include a solenoid and regulator mechanism. Moreover, control device 42 may include a timer mechanism which acts to keep air flowing to air motor 47, and thereby keep vanes 41 rotating, for a predetermined time, which may be variable, after an operator pushes control button 48. When no air is provided to air motor 47, former roll 10 may rotate freely under the action of moving web 1 during printing operations, for example.

Figure 4:
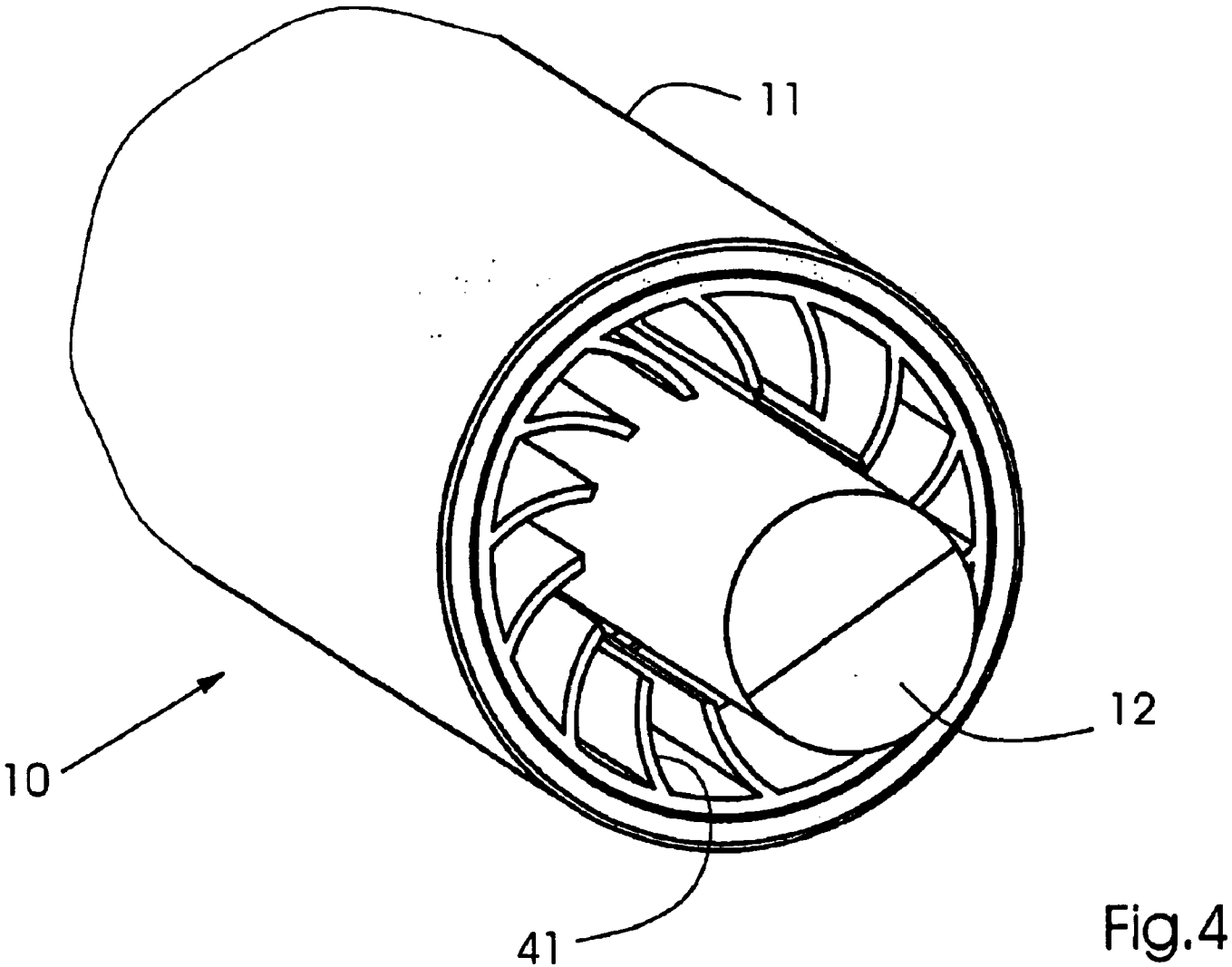
FIG. 4 shows a perspective partial view of a former roll according to the embodiment of the present invention shown in FIG. 3.

FIG. 4 shows a perspective partial view of former roll 10. Vanes 41 project inward from cylindrical member 11. Vanes 41 may be formed integrally with cylindrical member 11 or may be attached to the cylindrical member. In other embodiments of the present invention, vanes 41 may be separate from, but connected to, cylindrical member 11 so that the cylindrical member rotates when the vanes move under the action of air against the vanes.

Figure 5:
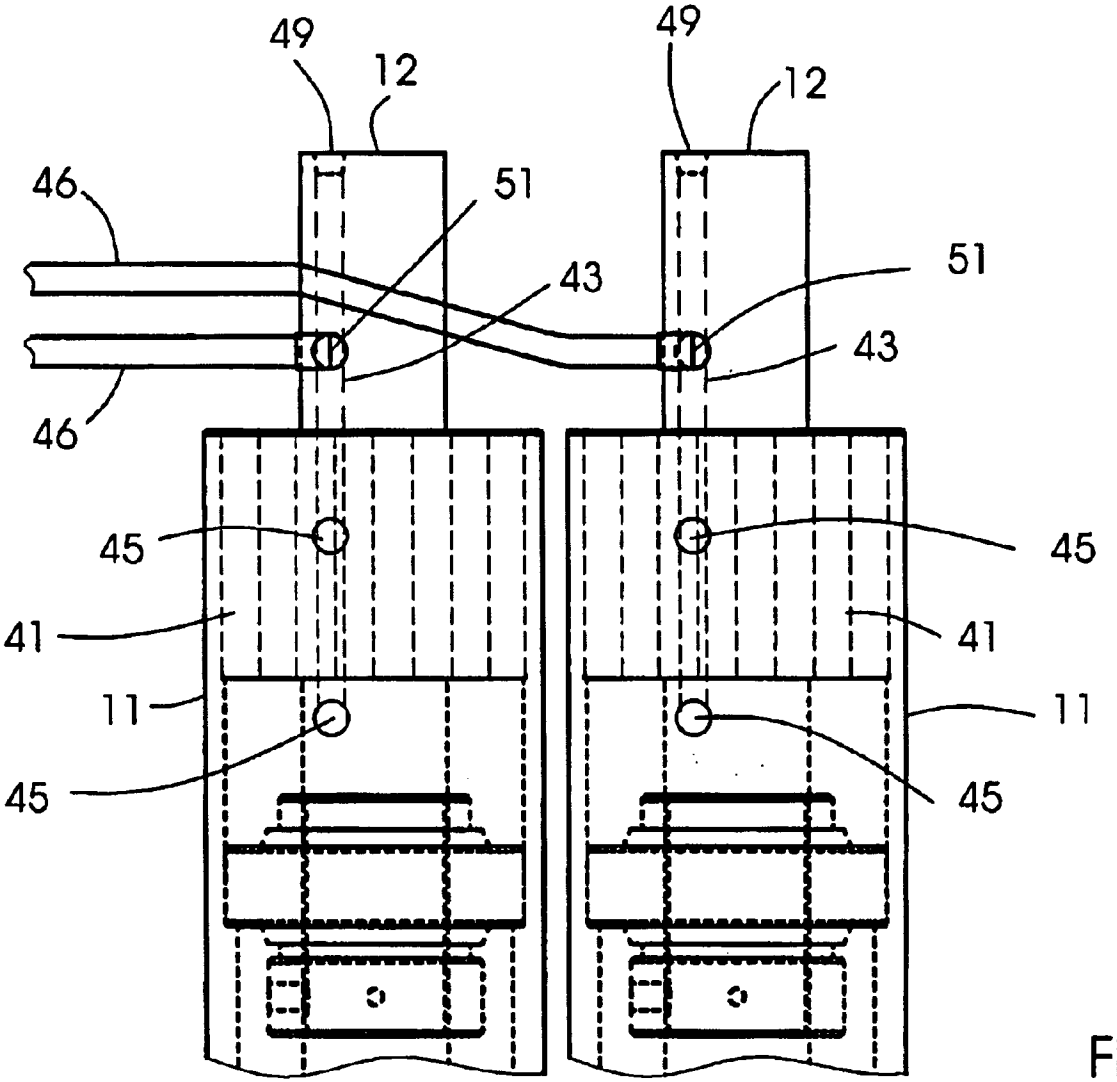
FIG. 5 shows a schematic plan view of a pair of former rolls according to an embodiment of the present invention.

FIG. 5 shows a schematic plan view of a pair of former rolls according to an embodiment of the present invention in which air nozzle 45 is integrated into shaft 12. In this embodiment, shaft 12 is provided with drilled passage 43. Passage 43 is closed with plug 49. Air line 46 is connected to passage 43 via fitting 51. Nozzle 45 is integrated into shaft 12 at any desired position, or combination of positions, along passage 43, as shown in FIG. 5. Air flows from control device 42, through air lines 46, into passage 43 and out nozzle 45 to impinge against vanes 41. This embodiment enables vanes 41 to be disposed in any longitudinal position along cylindrical member 11.

Figure 6A:
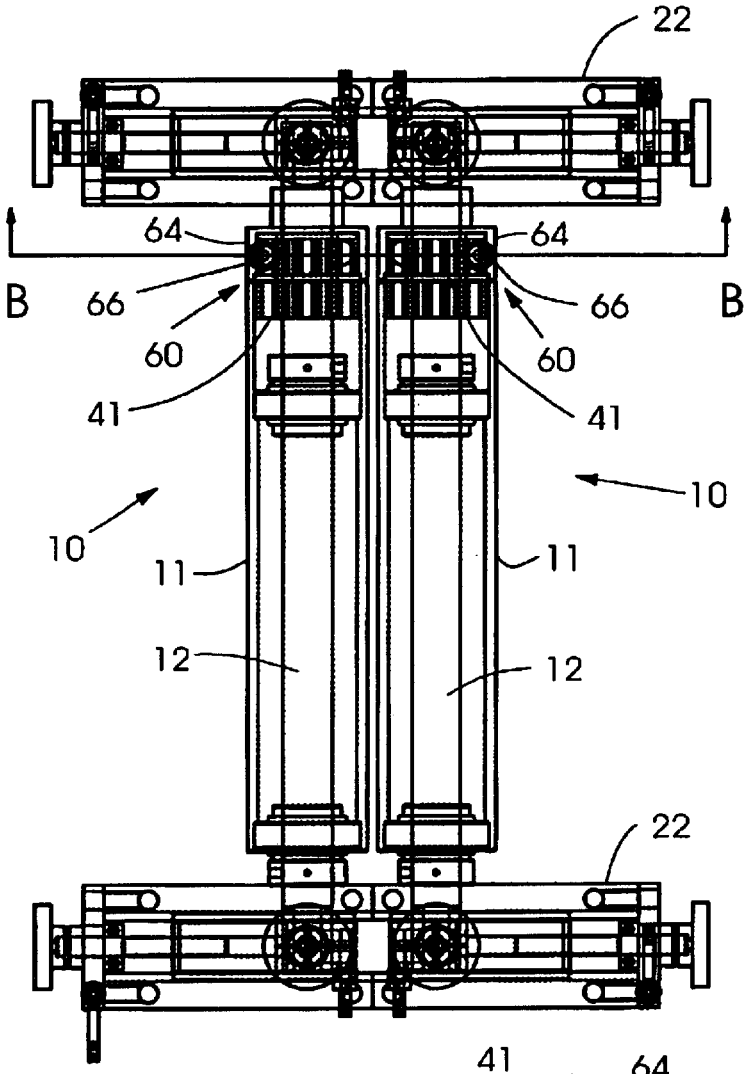
FIG. 6A shows a schematic plan view of a former roll portion of a former according to an embodiment of the present invention.
Figure 6B:
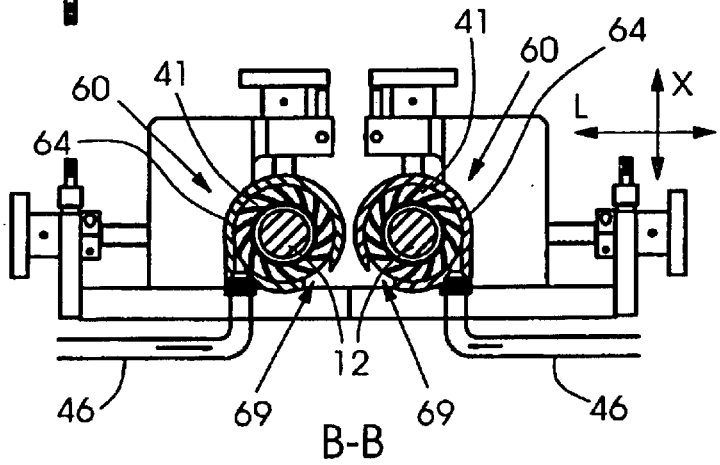
FIG. 6B shows a schematic cross-sectional view along section B—B of the former roll portion of FIG. 6A.
Figure 6C:
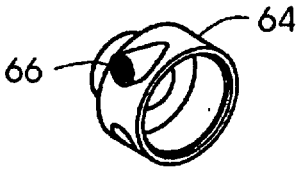
FIG. 6C shows a perspective view of the vane housing of the former roll portion of FIGS. 6A and 6B.

FIGS. 6A–C show another embodiment of the present invention using an air motor 60 with vanes 41 disposed on an end portion of shaft 12 outside of cylindrical member 11. Housing 64 serves as enclosure for vanes 41 and to prevent damage to the vanes, as well as providing enhanced control of air flow to the vanes, and thereby more power to rotate former roll 10. Air is supplied to housing 64 from air line 46 via air inlet 66. Housing 64 may be slidably and rotatably supported relative to, and even on, shaft 12, and at least a portion of air line 46 may be flexible so that air motor 60 may move with former roll 10 when the position of former roll 10 is adjusted using adjustment device 22. A control device 42 (not shown in FIGS. 6A–C), as described above with reference to FIG. 3, may be provided for controlling air motor 60. Air flows from control device 42, through air line 46, and into housing 64 via air inlet 66 to impinge against vanes 41 and exits at opening 69.

In other embodiments of the present invention, other types of motors may be used to rotate cylindrical member 11. For example, other types of fluid motors, such as hydraulic motors may be used. Additionally, each former roll 10 may be provided with a motor at each end of shaft 12, to provide additional torque for rotating larger rolls, for example.

By properly controlling the rotation of cylindrical members 11, operator can feed web through former rolls 10 in a controlled and safe manner without the need to rotate the former rolls by hand. By disengaging the motor, i.e., removing the electrical power, air flow, etc., to the motor, cylindrical member 11 may rotate freely during printing operations under action of the moving web. Since the motor is located at the axis of rotation and no contact devices, such as belts, etc., are required between the motor and cylindrical member 11, the former roll according to the present invention has a compact and simple design. The former roll according to the present invention may also be decelerated or stopped using the provided motor. Moreover, the former roll according to the present invention may also be used in conjunction with an automatic webbing system.

It will of course be understood that the present invention has been described above only by way of example and that modifications of details can be made within the scope of the invention. For example, the roll of the present invention is not limited to former roll applications, but may be used for other rolls in a web printing press.

What is claimed is:

1. A roll for a web printing press, comprising:

a cylindrical member configured for supporting a web, the cylindrical member being rotatable about an axis of rotation;

a fluid motor device disposed at the axis of rotation and configured for rotating the cylindrical member so as to advance the web over the cylindrical member during a webbing-up operation, the motor device configured to permit the cylindrical member to rotate freely during a printing operation of the printing press; the fluid motor being an air motor including a plurality of vanes attached to the cylindrical member and an air source configured for blowing air against the vanes so as to cause the cylindrical member to rotate; and a control device for controlling a flow of air to the air motor, the control device being configured for stopping the flow of air to the air motor a predetermined time after actuation of an operator air flow activation device.

2. The roll as recited in claim 1 wherein the cylindrical member is movable vertically and horizontally and wherein the motor device is movable therewith.

3. The roll as recited in claim 1 wherein the vanes are housed within the cylindrical member.

4. The roll as recited in claim 1 wherein the vanes are housed within a housing disposed at an end of the cylindrical member.

5. The roll as recited in claim 1 wherein the cylindrical member has a shaft and the air source includes an air outlet integrated in the shaft and disposed so as to blow air against the vanes.

6. The roll as recited in claim 1 wherein the air source includes an air outlet disposed outside the cylindrical member so as to blow air against the vanes.

7. The roll as recited in claim 1 wherein the motor device is operable in conjunction with an automatic webbing-up system.

8. The roll as recited in claim 1 wherein during the printing operation the web rotates the cylindrical member.

9. The roll as recited in claim 1 wherein the roll is a former roll.

10. A web printing press comprising:

a cylindrical member configured for supporting a web, the cylindrical member being rotatable about an axis of rotation; and a fluid motor device disposed at the axis of rotation and configured for rotating the cylindrical member so as to advance the web over the cylindrical member during a webbing-up operation, the motor device configured to permit the cylindrical member to rotate freely during a printing operation of the printing press; and a control device for controlling a flow of fluid to the motor, the control device being configured for stopping the flow of electricity or fluid to the motor a predetermined time after actuation of an operator activation device.

11. The web printing press as recited in claim 10 wherein the cylindrical member and motor device define a roll, the roll being a former roll.

12. The web printing press as recited in claim 10 wherein during the printing operation the web rotates the cylindrical member.

13. A method for rotating a roll in a web printing press, the method comprising:

providing a motor device disposed at an axis of rotation of the roll and configured for rotating the roll so as to advance the web over the roll;

operating the motor device so as to rotate the roll during a webbing-up operation;

disengaging the motor device so as to permit the roll to rotate freely during a printing operation of the printing press; the motor device being an electric motor or a fluid motor; and stopping the flow of fluid to the fluid motor a predetermined time after actuation of an operator activation device.

14. The method as recited in claim 13 further comprising rotating the roll using the web during the printing operation.

* * * * *